US007815329B2

(12) United States Patent
Scali et al.

(10) Patent No.: US 7,815,329 B2
(45) Date of Patent: Oct. 19, 2010

(54) WATERFALL UNIT

(75) Inventors: Ian P. A. Scali, Ontario, CA (US); Erica A. Moir, Santa Ana, CA (US); Charles S. Bonzagni, Ventura, CA (US); Adrian Alfaro, Menifee, CA (US)

(73) Assignee: Sundance Spas, Inc., Chino, CA (US)

( * ) Notice: Subject to any disclaimer, the term of this patent is extended or adjusted under 35 U.S.C. 154(b) by 374 days.

(21) Appl. No.: 11/877,241

(22) Filed: Oct. 23, 2007

(65) Prior Publication Data

US 2008/0101054 A1 May 1, 2008

Related U.S. Application Data

(60) Provisional application No. 60/854,274, filed on Oct. 25, 2006.

(51) Int. Cl.
*F21V 33/00* (2006.01)
*E04H 4/12* (2006.01)
*F21V 31/00* (2006.01)

(52) U.S. Cl. ..... 362/96; 4/507

(58) Field of Classification Search ..... 362/96, 362/202, 205, 208; 4/507, 509
See application file for complete search history.

(56) References Cited

U.S. PATENT DOCUMENTS 6,595,435 B1 7/2003 Cardenas
6,595,675 B2 7/2003 Dongo
7,162,752 B2 1/2007 McDonald et al.
7,200,879 B2 4/2007 Li et al.
7,229,027 B2 6/2007 Ehresman et al.
7,254,847 B2 8/2007 Kunkel
2005/0235407 A1 * 10/2005 Kunkel ..... 4/507
2007/0053174 A1 * 3/2007 Lin ..... 362/96

* cited by examiner

*Primary Examiner*—David V Bruce
(74) *Attorney, Agent, or Firm*—The Webb Law Firm

(57) ABSTRACT

A waterfall unit for use in a spa includes a body defining a bowl, a beveled arcuate outer edge surface which curves over the bowl and a water entrance port in communication with the bowl. The water entrance port is located in the bottom of the bowl. A deflector cap is spaced away from and over the water entrance port. Water flows upwardly through the water entrance port in a fountain-like manner. This water contacts the deflector cap which deflects the water and causes it to flow laterally and into the bowl. When the bowl fills with water, the water flows over the beveled outer edge surface to create a waterfall. The body further defines a flat back wall for mounting the waterfall unit against a spa wall. The body has a substantially curved body profile formed by the bowl and the beveled outer edge surface.

31 Claims, 8 Drawing Sheets

WATERFALL UNIT

CROSS-REFERENCE TO RELATED APPLICATIONS

This application claims the benefit of U.S. Provisional Patent Application No. U.S. 60/854,274 filed Oct. 25, 2006 which is hereby incorporated by reference in its entirety.

BACKGROUND OF THE INVENTION

1. Field of the Invention

The present invention relates to a waterfall unit for use in swimming pools, spas, hot tubs and the like. More specifically, the waterfall unit of the invention may be considered as being a combination fountain and waterfall.

2. Description of the Related Art

Fountains and waterfall units are generally used in spas, swimming pools, tubs and the like (collectively referred to as "spas" or "spa") for aesthetic, therapeutic and practical reasons in that they may be decorative, visually appealing and/or may provide a soothing sound providing a calming affect to the users of the spa. As such, users and owners of spas often desire the addition of waterfalls or fountains.

Some conventional waterfall units are located behind the wall of the spa where it is connected to the spa's plumbing and the only visible portion is its outlet from which a smooth laminar flow runs from the spa's edge to the surface of the water below. Such examples are those disclosed in U.S. Pat. Nos. 6,595,435 B1; 6,595,675 B2; 7,162,752 B2; 7,229,027 B2; and 7,254,847 B2. These prior art waterfall units either have an elongated slot located on an upper edge of a spa wall for delivering a laminar flow of water or, as disclosed in the aforesaid U.S. Pat. No. 7,162,752 B2, have one or more nozzles in the top edge of the spa for forming streams of water created by a venture nozzle located in a plenum chamber. These units may also contain baffles and/or dividers for transforming the turbulent water from the spa's water supply into a smooth laminar flow. Additionally, these waterfall units may have a light source near the mouth of the elongated slot to illuminate the water flowing from the slot as disclosed, for example in the aforesaid U.S. Pat. Nos. 6,595,675 B2; 7,162,752 B2; 7,229,027 B2; and 7,254,847 B2.

There is a need for a waterfall device that can be installed in the external wall of the spa thereby minimizing installation costs and/or eliminating the need for a system of baffles and/or dividers for quieting the water to produce a smooth laminar waterfall and still fulfilling the aesthetic, practical and therapeutic reasons for adding a waterfall device to a fulfilling the aesthetic, practical and therapeutic reasons for adding a waterfall device to a spa. There is also a need in the art to provide a waterfall device that can be retrofitted on existing spas.

SUMMARY OF THE INVENTION

The present invention has met these needs. The present invention relates to a waterfall unit that preferably is installed externally along the top edge of a wall of the spa. The waterfall unit includes a body defining a bowl, a beveled outer edge surface which curves over the bowl and a water entrance port in communication with the bowl. Water flows from the water entrance port and into the bowl. The water entrance port is located in the bottom of the bowl and directs water upwardly into the bowl. A deflector cap is supported away from and over the water entrance port by vertical support members, which encircle the water entrance port. Water flows upwardly through the water entrance port in a fountain-like manner. This water contacts the deflector cap which deflects the water and causes it to flow laterally and into the bowl. When the bowl fills with water, the water flows over the beveled outer edge surface to create a waterfall. The body further defines a flat wall located adjacent the bowl for mounting the waterfall unit against a spa wall. The body has a substantially curved body profile and the bowl of the body has an internal curved surface.

A further embodiment of the invention provides, in combination with a waterfall unit, a spa for holding water and having a top wall area with at least one recessed area for supporting the waterfall unit. The waterfall unit includes a body defining a bowl, a beveled outer edge surface which curves over the bowl and a water entrance port in fluid communication with the bowl, whereby water flows from the water entrance port and into the bowl. When the bowl fills with water, the water flows over the beveled outer edge surface to create a waterfall. A deflector cap is spaced away from the water entrance port by a plurality of vertical support members. The deflector cap deflects the water flowing from the water entrance port thereby causing the water to flow laterally and into the bowl. The water entrance port is structured to direct the water upwardly against the deflector cap. The body preferably is made of a transparent material and further defines a flat wall located adjacent to the bowl for mounting of the waterfall unit against a flat surface of the top wall area of the recessed area. The body has a substantially curved body profile and the bowl has an internal curved surface. The waterfall also includes a cylindrical support mounted in the recessed area of the top wall area of the spa for supporting the body of the waterfall unit. The cylindrical support has a threaded portion and is in fluid communication with the water entrance port. The water entrance port further includes a gasket member and a nut having a projecting outer rim and an LED source for illuminating the projecting outer rim. The nut is positioned around the conduit in a manner that the projecting outer rim directs light upward through the water entrance port and into the bowl of the waterfall unit.

These and other features and characteristics of the present invention will become more apparent upon consideration of the following description with reference to the accompanying drawings, all of which form a part of this specification, wherein like reference numerals designate corresponding parts in the various figures.

DETAILED DESCRIPTION OF THE INVENTION

Figure 1:
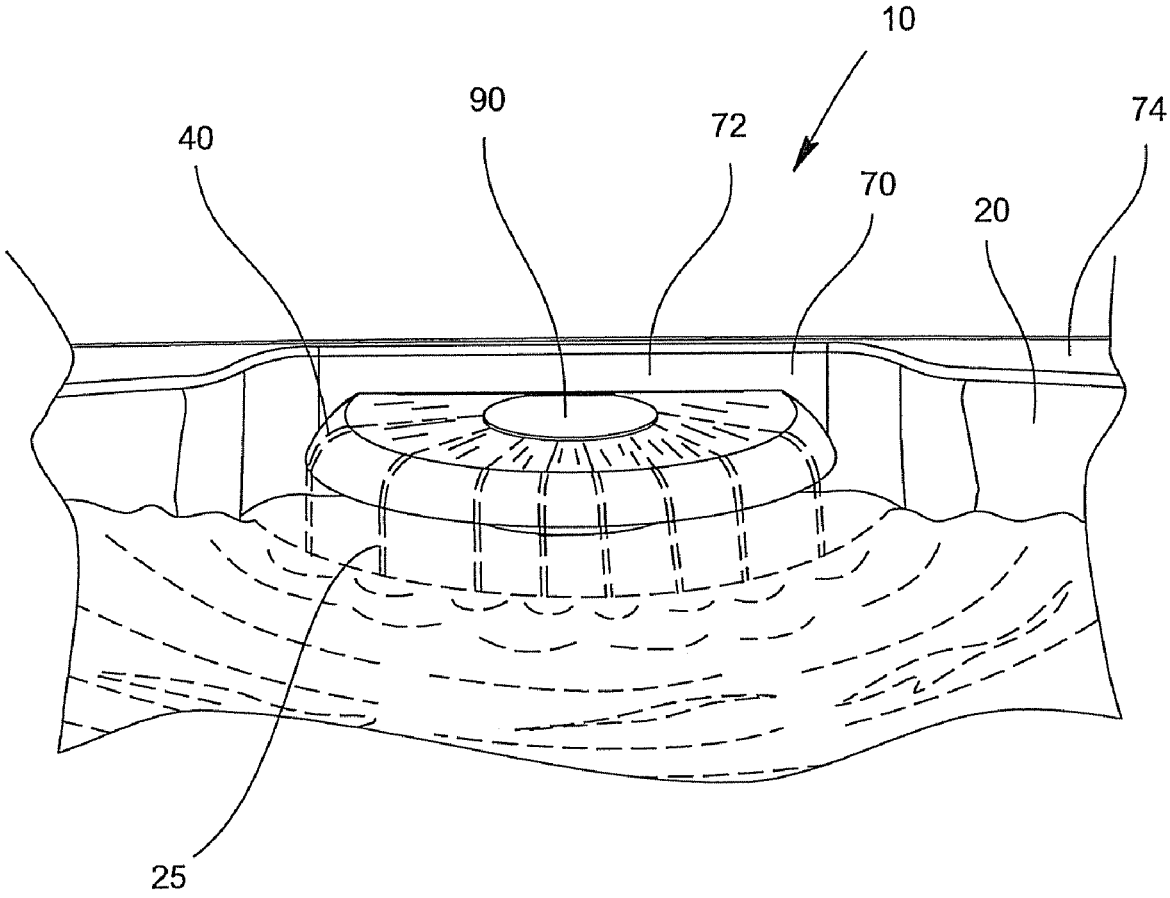
FIG. 1 is a front perspective view of a waterfall unit made in accordance with the present invention and illustrating a waterfall flowing from the waterfall unit.

FIG. 1 shows a waterfall unit 10 for use with a spa 20 and made in accordance with the teachings of the present invention. As can be seen, the waterfall unit 10 has a waterfall 25 flowing thereover.

Figure 2:
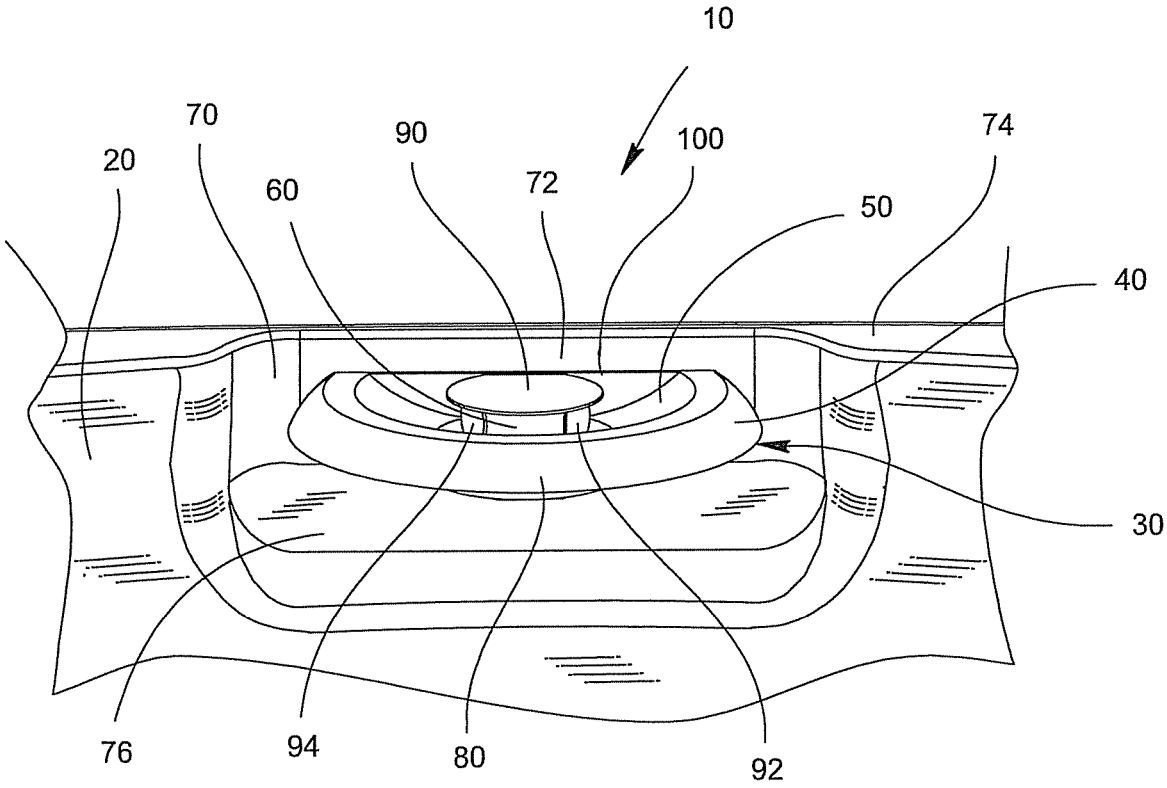
FIG. 2 is a front perspective view of the waterfall unit shown in FIG. 1 without the waterfall and installed in a recessed area of a spa.

Referring to FIG. 2, the waterfall unit 10 includes a body having a substantially curved body profile as indicated at reference numeral 30. Body 30 defines a beveled arcuate outer edge surface 40, an internal curved bowl 50, a water entrance port 60 which is in fluid communication with the bowl 50, and a flat back wall 100. This construction of the waterfall unit 10 of FIG. 2 permits water to flow into the bowl 50 and along the beveled outer edge surface 40 as shown at reference numeral 25 in FIG. 1.

Figure 3:
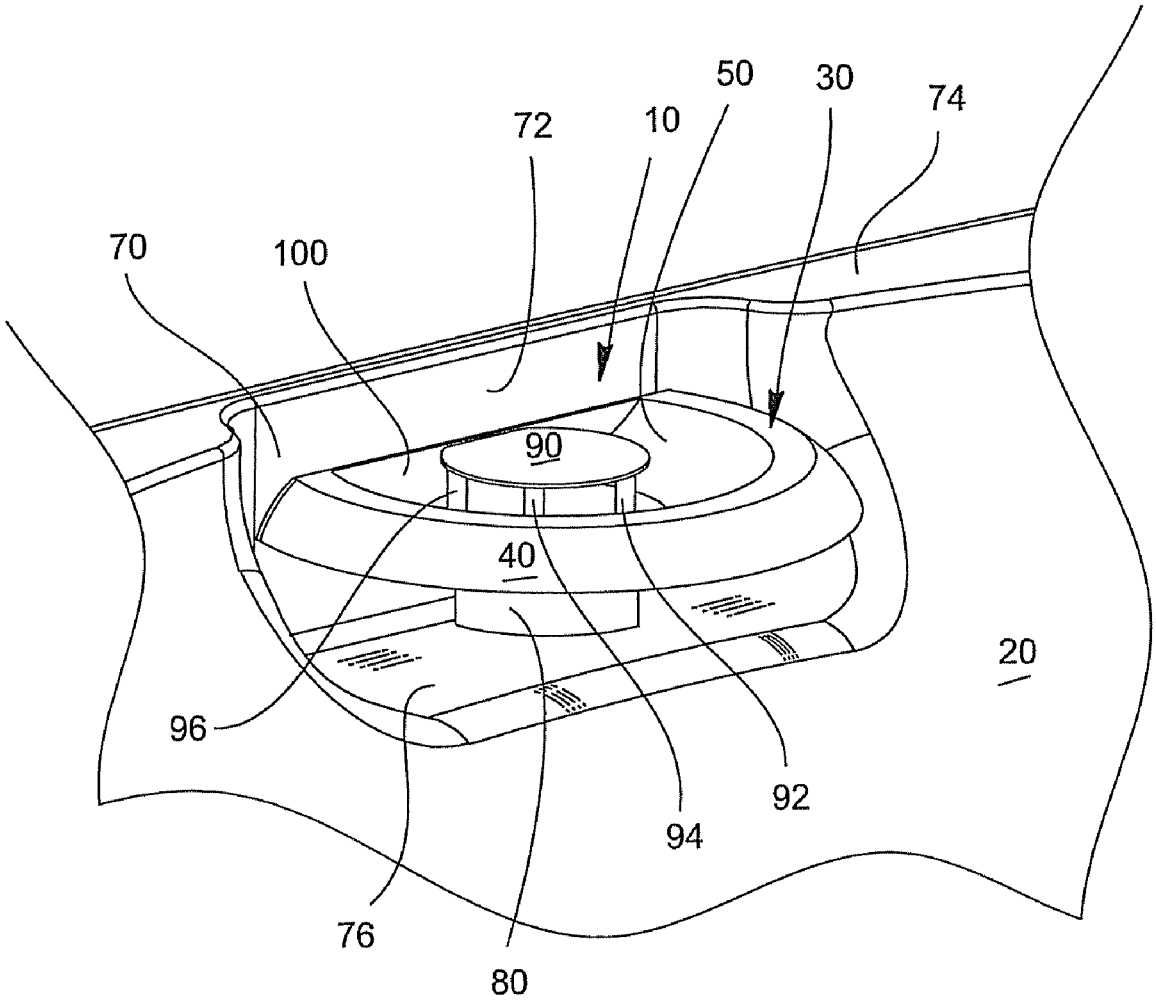
FIG. 3 is a side perspective view of the waterfall unit shown in FIG. 2.
Figure 4:
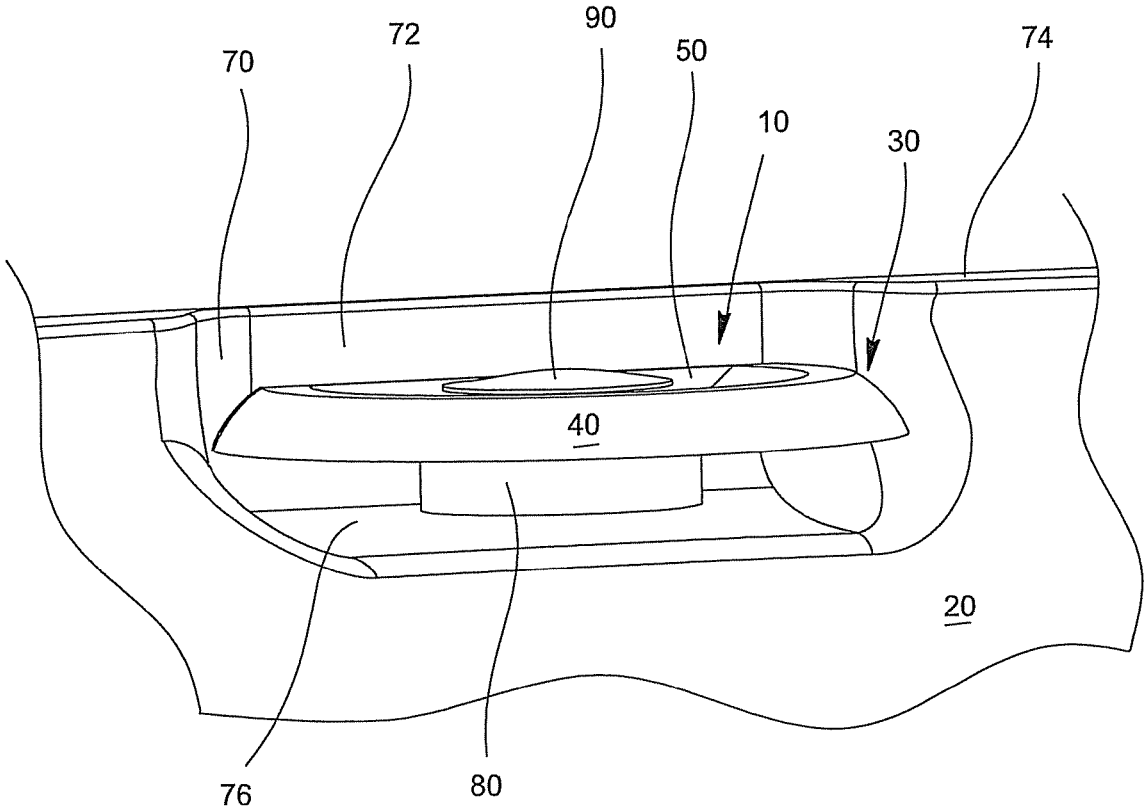
FIG. 4 is a front perspective view of the waterfall unit shown in FIG. 2.
Figure 5:
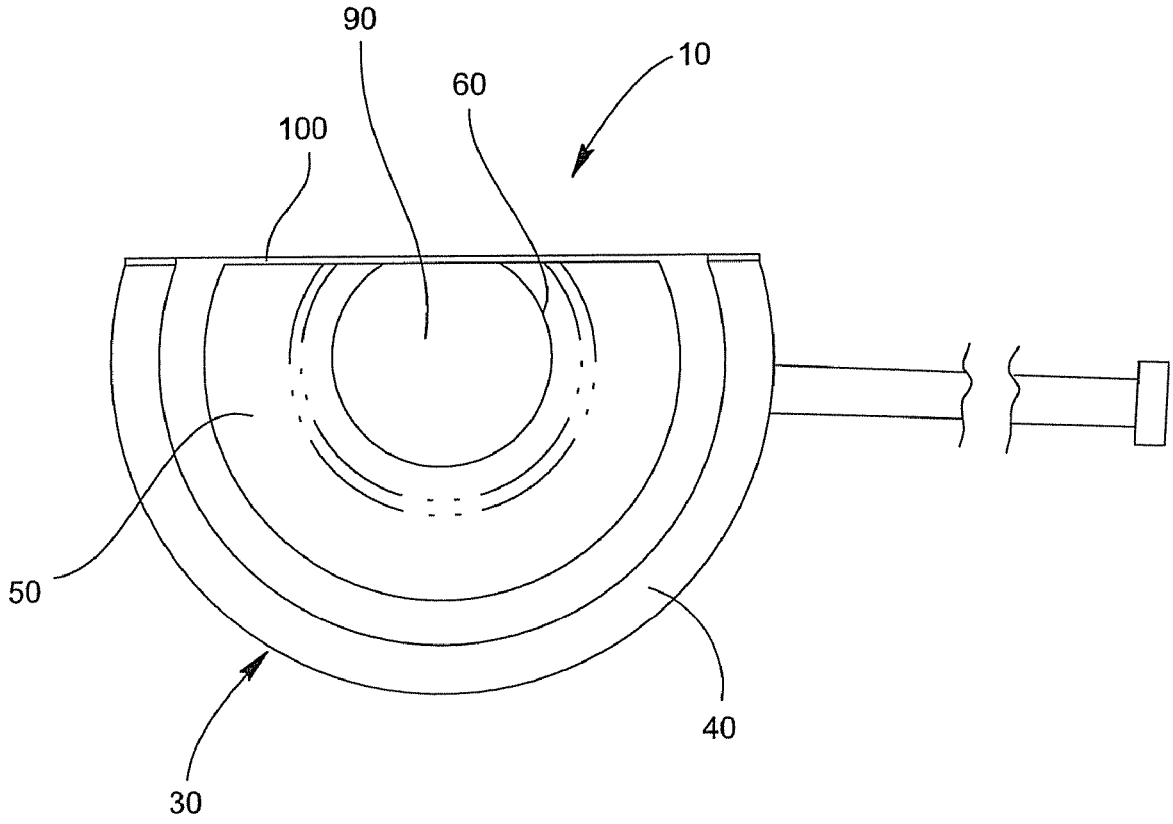
FIG. 5 is a top perspective view of a waterfall unit shown in FIG. 2.
Figure 7:
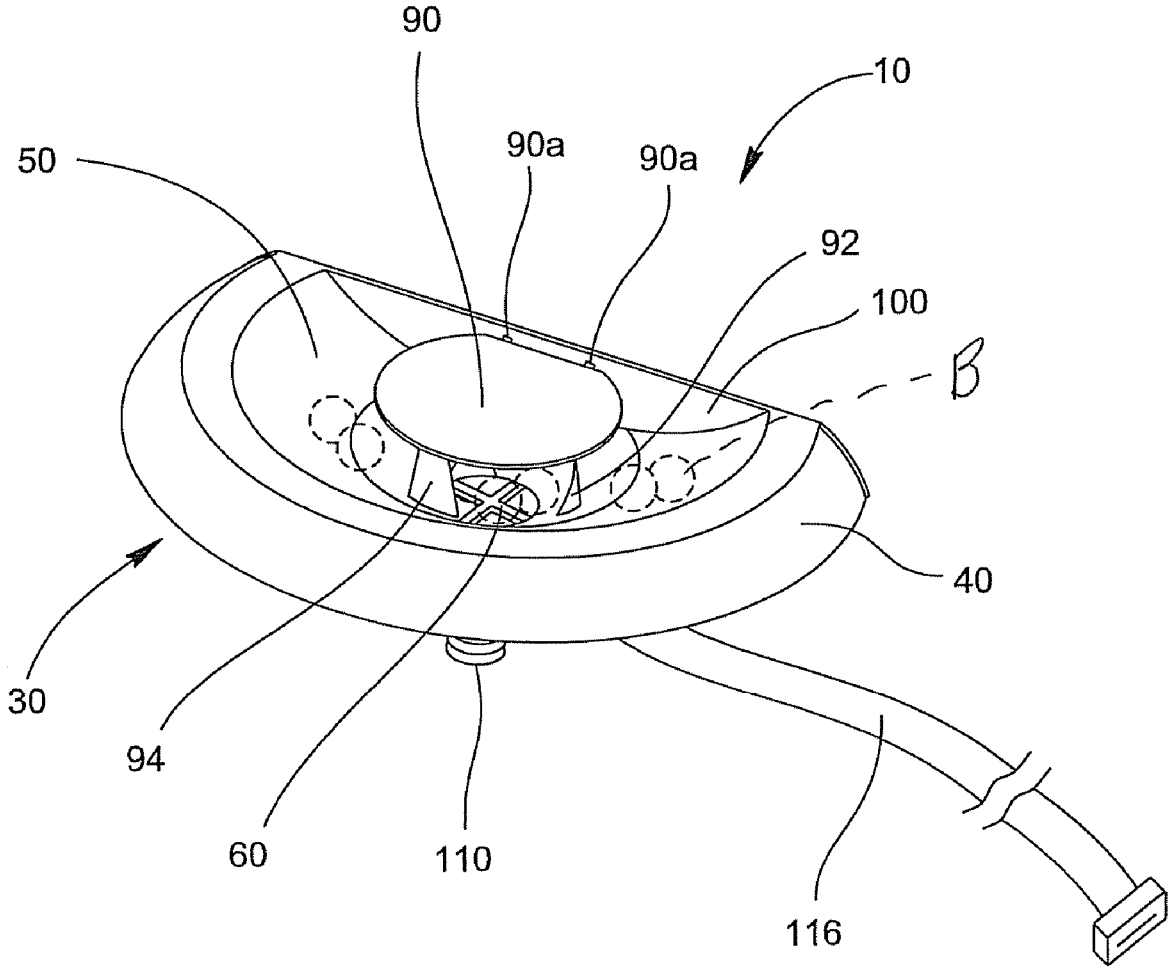
FIG. 7 is a side perspective view of the waterfall unit of FIG. 5.
Figure 8:
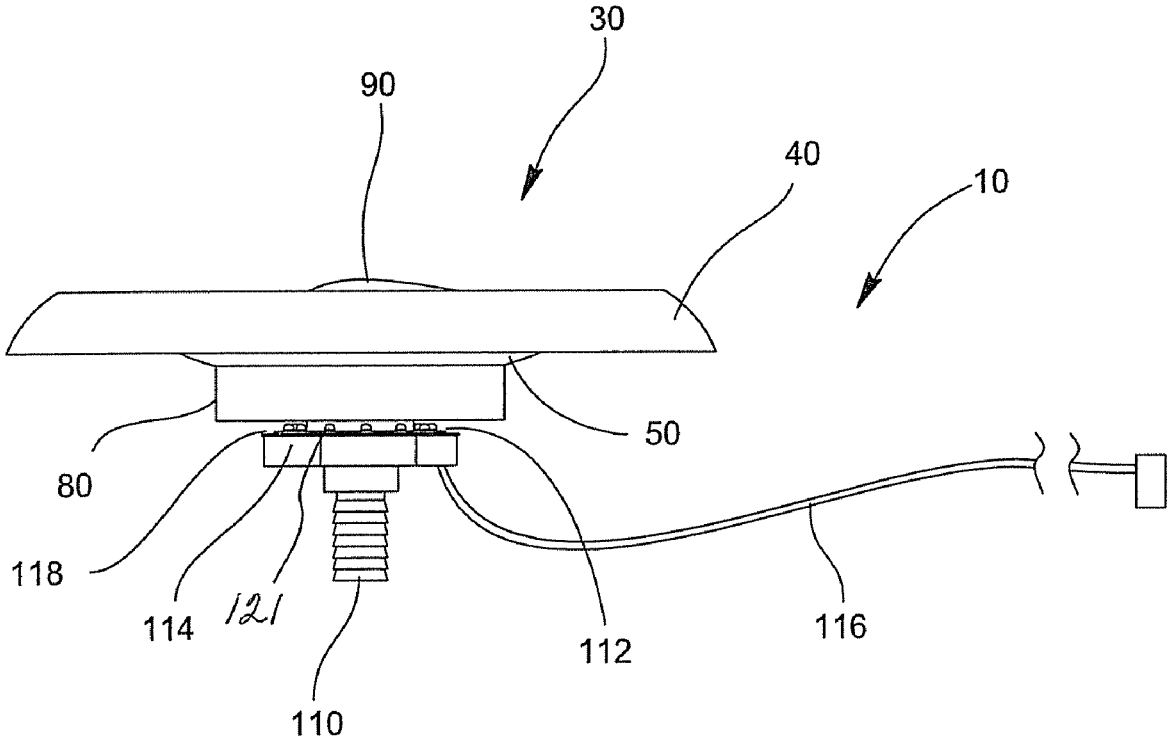
FIG. 8 is a front elevation view of the waterfall unit of FIG. 5.

Referring to FIGS. 3-4, the waterfall unit 10 is received within a recessed area 70 and against a flat surface 72 of a top wall area 74 of the spa 20. As shown best in FIGS. 3 and 8, the body 30 of the waterfall unit 10 is attached to a cylindrical support 80 that supports the body 30 on a floor 76 of the recessed area 70 of the spa 20. As best shown in FIG. 8, this cylindrical support 80 is connected to the underside of the bowl 50 and forms an opening of the water entrance port 60 as shown in FIG. 7. This cylindrical support 80 may be a separate component of the bowl 50 or it can either be glued to the bowl 50 or it can be integrally formed with the bowl 50 in a thermoplastic molding process for making the bowl 50. In a preferred embodiment, the cylindrical support 80 is thermoplastically molded with the bowl 50.

As particularly shown in FIGS. 3-4 and as stated hereinabove, cylindrical support 80 is supported on the floor 76 of the recessed area 70 of the spa 20. For this purpose, a corresponding opening (not shown) will be provided in the floor 76 of the recessed area. This cylindrical support 80 receives the water entrance port 60 of the waterfall unit 10, more about which will be discussed with reference to FIGS. 6-8.

Figure 6:
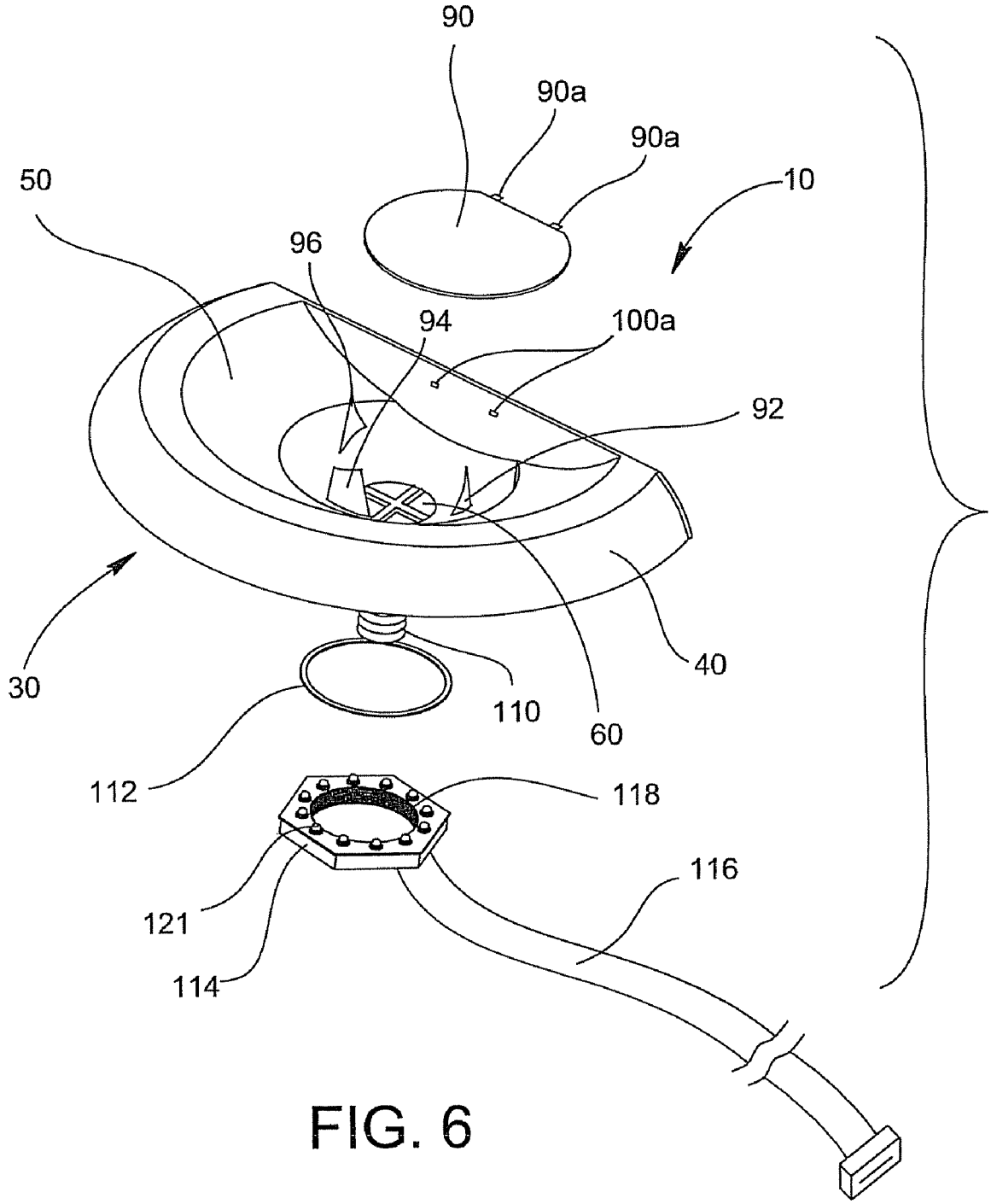
FIG. 6 is an exploded perspective view of the waterfall unit of FIG. 5.

With particular reference to FIGS. 4-8, a deflector cap 90 is provided. As best shown in FIGS. 6-7, deflector cap 90 is spaced away from the water entrance port 60 and is supported by support members 92, 94 and 96 (FIG. 6) which partially encircle the opening of the water entrance port 60. As particularly shown in FIG. 7, deflector cap 90 is connected to the flat back wall 100 of body 30, and as best shown in FIG. 6, this connection is made via knobs 90*a* protruding from deflector cap 90 which snap into corresponding openings 100*a* of flat back wall 100 of body 30.

As discussed hereinabove, water entrance port 60 is defined by an annular opening within cylindrical support 80. As shown best in FIG. 8, water entrance port 60 is also in fluid communication with a threaded conduit 110 which extends into an annular opening (not shown) of the cylindrical portion 80 of the waterfall unit 10. Referring particularly to FIGS. 6-7, when the waterfall unit 10 is assembled and water is supplied through conduit 110, the water exits through the water entrance port 60 and preferably flows upwardly and contacts the underside of the deflector cap 90. The deflector cap 90 deflects the water thereby preventing the upward flow stream of the water. This deflection causes the water to flow laterally out of the bowl 50 and over the beveled outer edge surface 40 of body 30.

Referring particularly to FIGS. 6 and 8, the waterfall unit 10 further includes a gasket member 112, a nut 114 and a light source 116 connected to nut 114. As best shown in FIG. 6, nut 114 has a projecting outer rim 118 which contains an illumination source, for example an LED or a plurality of LEDS, one of which is indicated at reference numeral 121, for illuminating the body 30 and the projecting outer rim 40 via light source 116. Nut 114 is positioned around the threaded conduit 110 in a manner that the light from the outer rim 118 of nut 114 is directed up through the water entrance port 60 and into the bowl 50 of the waterfall unit 10.

As best shown in FIGS. 6-7, the beveled outer edge surface 40 of the body 30 curves over the bowl 50 to produce a substantially curved profile for body 30. In operation, water enters the water entrance port 60. It flows upwardly and contacts the underside of the deflector cap 90 at which point it flows laterally in the bowl. The water fills the bowl 50 and then flows over the beveled arcuate outer edge surface 40 as shown at reference numeral 25 in FIG. 1 to give a pleasing waterfall effect. Preferably, the waterfall unit 10 is molded from thermoplastic and may be retrofitted on existing spas. As shown in FIGS. 3-4, the waterfall unit 10 is supported on the floor 76 of the recessed area 70 of the spa 20 whereby the flat wall surface 100 of body 30 abuts a corresponding flat surface 78 of the top wall area of the recessed area 70. Also, as is apparent, the threaded conduit 110 is connected to a water supply (not shown) for delivering water into the waterfall unit 10, and the light source 116 is connected to an electrical outlet (not shown) for illuminating the water entrance port 60.

As shown in phantom in FIG. 7, a plurality of decorative beads indicated at B may be placed in bowl 50. These beads may be transparent or may be colored and opaque. If the beads B are transparent, the light illuminating from the illumination source, i.e. the plurality of LEDS 121 (FIG. 6) may also shine through the beads for an aesthetic and/or therapeutic effect.

The present invention has been described with reference to the preferred embodiments. Obvious modifications and alterations will occur to others upon reading and understanding the preceding detailed description. It is intended that the invention be construed as including all such modifications and alterations.

What is claimed is:

1. A waterfall unit comprising:

a body defining a bowl, a beveled outer edge surface having an arcuate shaped portion, said outer edge surface extending above and curving over the bowl and a water entrance port in fluid communication with the bowl, whereby water flows from the water entrance port and into the bowl, and when the bowl fills with water, the water flows over the arcuate shaped portion of the beveled outer edge surface to create a waterfall.

2. The waterfall unit of claim 1 further comprising a deflector cap spaced away from the water entrance port for deflecting the water flowing from the water entrance port and causing the water to flow laterally and into the bowl.

3. The waterfall unit of claim 2 further comprising at least one support member for supporting the deflector cap.

4. The waterfall unit of claim 2 wherein the water entrance port is structured to direct the water upwardly against the deflector cap.

5. The waterfall unit of claim 1 wherein the body is made of a transparent material.

6. The waterfall unit of claim 1 further comprising an illumination source associated with the water entrance port.

7. The waterfall unit of claim 1 wherein the body further defines a flat wall located adjacent to the bowl for mounting of the waterfall unit against a spa wall.

8. The waterfall unit of claim 1 wherein the body has a substantially curved body profile and wherein the bowl has an internal curved surface.

9. The waterfall unit of claim 1 further including a plurality of decorative beads arranged in the bowl.

10. The waterfall unit of claim 1 wherein the waterfall flows over the beveled outer edge to form at least a semi-circular arc about the bowl and the water entrance port.

11. The waterfall unit of claim 1 wherein the body does not include a spout, thereby forming a spoutless waterfall unit.

12. A spa for holding water and having a top wall area with at least one recessed area for supporting a waterfall unit, the waterfall unit comprising:

a body defining a bowl, a beveled outer edge surface having an arcuate shaped portion, said outer edge surface extending above and curving over the bowl and a water entrance port in fluid communication with the bowl, whereby water flows from the water entrance port and into the bowl, and when the bowl fills with water, the water flows over the arcuate shaped portion of the beveled outer edge surface to create a waterfall.

13. The spa of claim 12 further comprising a deflector cap spaced away from the water entrance port for deflecting the water flowing from the water entrance port and causing the water to flow laterally and into the bowl.

14. The spa of claim 13 further comprising at least one support member for supporting the deflector cap.

15. The spa of claim 13 wherein the water entrance port is structured to direct the water upwardly against the deflector cap.

16. The spa of claim 12 wherein the body is made of a transparent material.

17. The spa of claim 12 further comprising an illumination source associated with the water entrance port.

18. The spa of claim 12 wherein the body further defines a flat wall located adjacent to the bowl for mounting of the waterfall unit against a flat surface of the top wall area of the recessed area.

19. The spa of claim 12 wherein the body has a substantially curved body profile and wherein the bowl has an internal curved surface.

20. The spa of claim 12 further comprising a cylindrical support mounted in the recessed area of the top wall area of the spa for supporting the body of the waterfall unit.

21. The spa of claim 20 wherein the cylindrical support has a threaded portion and wherein the water entrance port is in fluid communication with the cylindrical support.

22. The spa of claim 21 wherein the water entrance port further includes a gasket member and a nut having a projecting outer rim and an LED source for illuminating the projecting outer rim, and wherein the nut is positioned around the conduit in a manner that light is directed up through the water entrance port and into the bowl of the waterfall unit.

23. The spa of claim 12, further comprising a plurality of decorative beads arranged in the bowl.

24. The spa of claim 12 wherein the waterfall flows over the beveled outer edge to form at least a semi-circular arc about the bowl and the water entrance port.

25. The spa of claim 12 wherein the body of the waterfall unit does not include a spout, thereby forming a spoutless waterfall unit.

26. A method for creating a waterfall, the steps comprising:

providing a waterfall-unit that is comprised of a body defining a bowl, a beveled outer edge surface having an arcuate shaped portion, said outer edge surface extending above and curving over the bowl and a water entrance port in fluid communication with the bowl, delivering an upward flow of water through the water entrance port, and causing the upward flow of water to deflect and to laterally flow into the bowl until the bowl fills with water and the water flows over the arcuate shaped portion of the beveled outer edge surface to create a waterfall.

27. The method of claim 26 wherein the waterfall flows over the beveled outer edge to form at least a semi-circular arc about the bowl and the water entrance port.

28. The method of claim 26 wherein the body of the waterfall unit does not include a spout, thereby forming a spoutless waterfall unit.

29. A method for creating an illuminated waterfall, the steps comprising:

providing a waterfall unit that is comprised of a body made of a transparent material and defining a bowl, a beveled outer edge surface having an arcuate shaped portion, said outer edge surface extending above and curving over the bowl and a water entrance port in fluid communication with the bowl, delivering an upward flow of water through the water entrance port, causing the upward flow of water to deflect and to laterally flow into the bowl until the bowl fills with water and the water flows over the arcuate shaped portion of the beveled outer edge surface to create a waterfall, and illuminating the water entrance port so that the illumination is directed through the transparent material of the body and through the waterfall.

30. The method of claim 29 wherein the waterfall flows over the beveled outer edge to form at least a semi-circular arc about the bowl and the water entrance port.

31. The method of claim 29 wherein the body of the waterfall unit does not include a spout, thereby forming a spoutless waterfall unit.

* * * * *